US006311972B1

(12) United States Patent
Carter

(10) Patent No.: US 6,311,972 B1
(45) Date of Patent: Nov. 6, 2001

(54) HIGH SPEED INVERTER AND REGISTRATION SERVO

(75) Inventor: Daniel L. Carter, Georgetown, KY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/487,581

(22) Filed: Jan. 19, 2000

(51) Int. Cl.[7] ..... B65H 7/02; G03G 15/00
(52) U.S. Cl. ..... 271/265; 399/364; 400/579
(58) Field of Search ..... 271/3.13, 3.15, 271/3.16, 186, 221, 234, 246, 258, 259, 265, 291; 399/364; 400/579

(56) References Cited

U.S. PATENT DOCUMENTS 4,873,547 * 10/1989 Sasaki et al. ..... 355/316 X
5,423,527 * 6/1995 Tranquilla ..... 271/10
5,560,595 * 10/1996 Kulpa ..... 271/2
5,687,010 * 11/1997 Van Tilborg et al. ..... 358/496
5,921,539 * 7/1999 Westcott et al. ..... 271/10.03 X
5,934,661 * 8/1999 Kameyama ..... 271/4.08
5,957,598 * 9/1999 Berkers et al. ..... 400/630

* cited by examiner

*Primary Examiner*—Christopher P. Ellis
*Assistant Examiner*—Kenneth W Bower
(74) *Attorney, Agent, or Firm*—Oliff & Berridge, PLC

(57) ABSTRACT

A feed out controller controls the feed out of a receiving substrate from an inverting station. Sensors mounted in the transfer station assist the feed out controller in determining the required adjustments to feed out. In a duplex copy mode, first and second receiving substrates are transported along a transport path. Feeding out the receiving substrate from the inverter station is adjusted based on a determined relationship between the trailing edge of the first receiving substrate and the leading edge of the second receiving substrate at the registration station and the inverting station. The stop time of the inverting roller is adjusted based the determined relationship. The feed out controller determines the trailing edge/leading edge relationships and then monitors the relationships during the print run. As the trailing edge/leading edge relationships change from nominal values, the feed out controller determines and applies the necessary adjustments to the inverting roller stop time to keep the developed images and the receiving substrates registered.

22 Claims, 6 Drawing Sheets

HIGH SPEED INVERTER AND REGISTRATION SERVO

BACKGROUND OF THE INVENTION

1. Field of Invention

This invention relates to methods and systems that control the feed out of a receiving substrate.

2. Description of Related Art

Various imaging systems include transport paths. Receiving substrates that will receive an image are conveyed along the transport paths and imaged. In duplex copying, the receiving substrates are fed into the transport path. Movement of the receiving substrates through the transport path is controlled so that the receiving substrates receive images. Receiving substrates receive images by passing along a transport path through an imaging station.

Multipass printing, such as duplex printing, is used to print images on a receiving substrate. For example, in duplex printing, images are formed on both sides of a receiving substrate.

Many imaging systems that are capable of duplex printing include receiving substrate transport paths in the shape of a loop. The scheduling process involves: a) inserting a receiving substrate into the loop; b) forming an image on a first side of the receiving substrate at an imaging station; c) inverting the receiving substrate so that a second side of the receiving substrate will face the imaging station when the receiving substrate is reconveyed past the imaging station; d) forming an image on the second side of the receiving substrate at the imaging station; and e) outputting the receiving substrate from the receiving substrate transport path loop toward a final destination, such as a tray, a binder, finishing devices, or the like.

SUMMARY OF THE INVENTION

Misregistration of a developed image on the receiving substrate, even if only a few mils or tens of microns, is well within the acuity of the human eye. Since the human eye can sense this misregistration, the quality of the resulting image suffers greatly even for small misregistration errors.

This invention provides imaging methods and systems wherein a developed image is to be substantially registered onto a receiving substrate.

This invention separately provides methods and systems that include a feed out controller that controls the feed out of the receiving substrate from an inverting station.

In accordance with the systems and methods of this invention, problems in registration, such as incorrect registration of a developed image with a receiving substrate, are reduced or eliminated.

This invention separately provides an image processing device that includes a feed out controller sensors mounted in the transfer station and a controller to determine the required adjustments to feed out.

The methods and systems of this invention improve the registration of the images onto the receiving substrate.

According to the systems and methods of this invention, registration errors that occur due to the misregistration of the developed images onto the receiving substrates can be reduced or eliminated by the application of the feed out controller.

In various exemplary embodiments of the systems and methods of this invention, a method of scheduling receiving substrates in a duplex copy mode includes transporting first and second receiving substrates along a transport path.

In various exemplary embodiments of the systems and methods of this invention, feeding out the receiving substrate from the inverter station is adjusted based on a determined relationship between the trailing edge of the first receiving substrate and the leading edge of the second receiving substrate at the registration station and the inverting station. In various other exemplary embodiments of the systems and methods of this invention, the stop time of the inverting roller is adjusted based the determined relationship.

The feed out controller determines the trailing edge/leading edge relationships and then monitors the relationships during the print run. As the trailing edge/leading edge relationships change from nominal values, the feed out controller determines and applies the necessary adjustments to the inverting roller stop time to keep the developed images and the receiving substrates registered.

These and other features and advantages of this invention are described in or are apparent from the following detailed description of various exemplary embodiments of the systems and methods according to this invention.

BRIEF DESCRIPTION OF THE DRAWINGS

The invention will be described in detail with reference to the following drawings in which like reference and numerals refer to like elements and wherein.

DETAILED DESCRIPTION OF PREFERRED EMBODIMENTS

Figure 1:
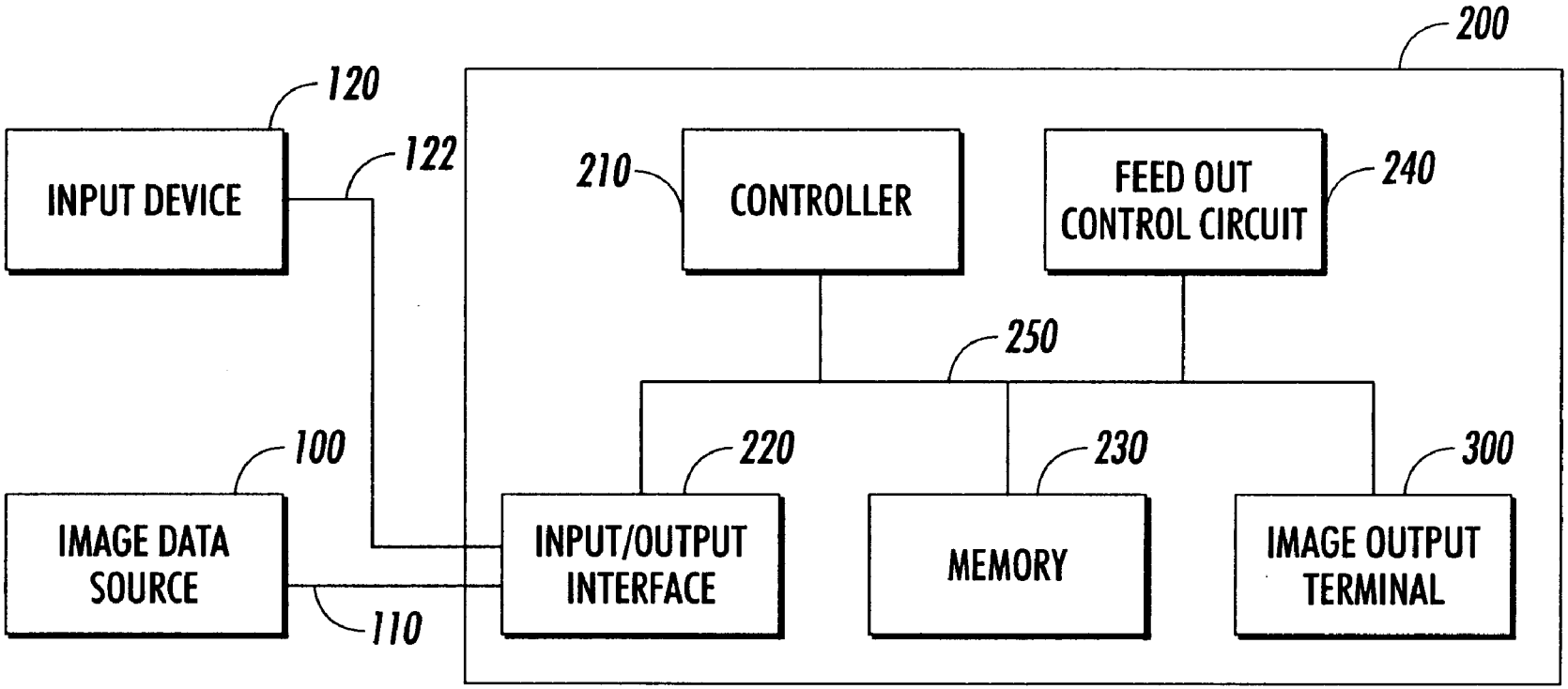
FIG. 1 shows one exemplary embodiment of a system which includes an image processing apparatus incorporating feed out control of this invention.

FIG. 1 shows one exemplary embodiment of a system which includes an image processing apparatus 200 incorporating feed out control in accordance with this invention. As shown in FIG. 1, an image data source 100 and an input device 120 are connected to the image processing apparatus 200 over links 10 and 122, respectively. The image data source 100 can be a digital camera, a scanner, or a locally or remotely located computer or any other known or later developed device that is capable of generating electronic image data. Similarly, the image data source 100 can be any suitable device that stores and/or transmits electronic image data such as a client or a server of a network.

The image data source 100 can be integrated with the image processing apparatus 200, as in a digital copier having an integrated scanner. Alternatively, the image data source 100 can be connected to the image processing apparatus 200 over a connection device, such as a modem, a local area network, a wide area network, an intranet, the Internet, any other distributed processing network, or any other known or later developed connection device.

It should also be appreciated that, while the electronic image data can be generated at the time of printing an image from electronic image data, the electronic image data could have been generated at any time in the past. Moreover, the electronic image data need not have been generated from an original physical document, but could have been created from scratch electronically.

The image data source 100 is thus any known or later developed device which is capable of supplying electronic image data over the link 110 to the image processing apparatus 200. The link 110 can thus be any known or later developed system or device for transmitting the electronic image data from the image data source 100 to the image processing apparatus 200.

The input device 120 can be any known or later developed device for providing control information from a user to the image processing apparatus 200. Thus, the input device 120 can be a control panel of the image processing apparatus 200, or a control program executing on a locally or remotely located general purpose computer or the like. As with the link 110 described above, the link 122 can be any known or later developed device for transmitting control signals and data input using the input device 120 from the input device 120 to the image processing apparatus 200.

As shown in FIG. 1, the image processing apparatus 200 includes a controller 210, an input/output interface 220, a memory 230, a feed out control circuit 240 and an image output terminal 300, each of which is interconnected by a control and/or data bus 250. The links 110 and 122 from the image data source 100 and the input device 120, respectively, are connected to the input/output interface 220. The electronic image data from the image data source 100 and any control and/or data signals from the input device 120 are input through the input interface, and, under control of the controller 210, are stored in the memory 230.

The memory 230 preferably has at least an alterable portion and may include a fixed portion. The alterable portion of the memory 230 can be implemented using static or dynamic RAM, a floppy disk and disk drive, a hard drive, flash memory, or any other known or later developed alterable volatile or non-volatile memory device. If the memory includes a fixed portion, the fixed portion can be implemented using a ROM, a PROM, an EPROM, and EEPROM, a CD-ROM and disk drive, a writable optical disk and disk drive, or any other known or later developed fixed memory device.

The feed out control circuit 240 inputs feed out signals from registration and inverting sensors in the image output terminal 300. The feed out control circuit adjusts the stop time of an inverting roller based on the input feed out signals to control when to feed a receiving substrate out of the inverting station in the transport section. The feed out control circuit 240 outputs the adjusted stop time to the image output terminal 300 over the control and/or data bus 250.

Figure 2:
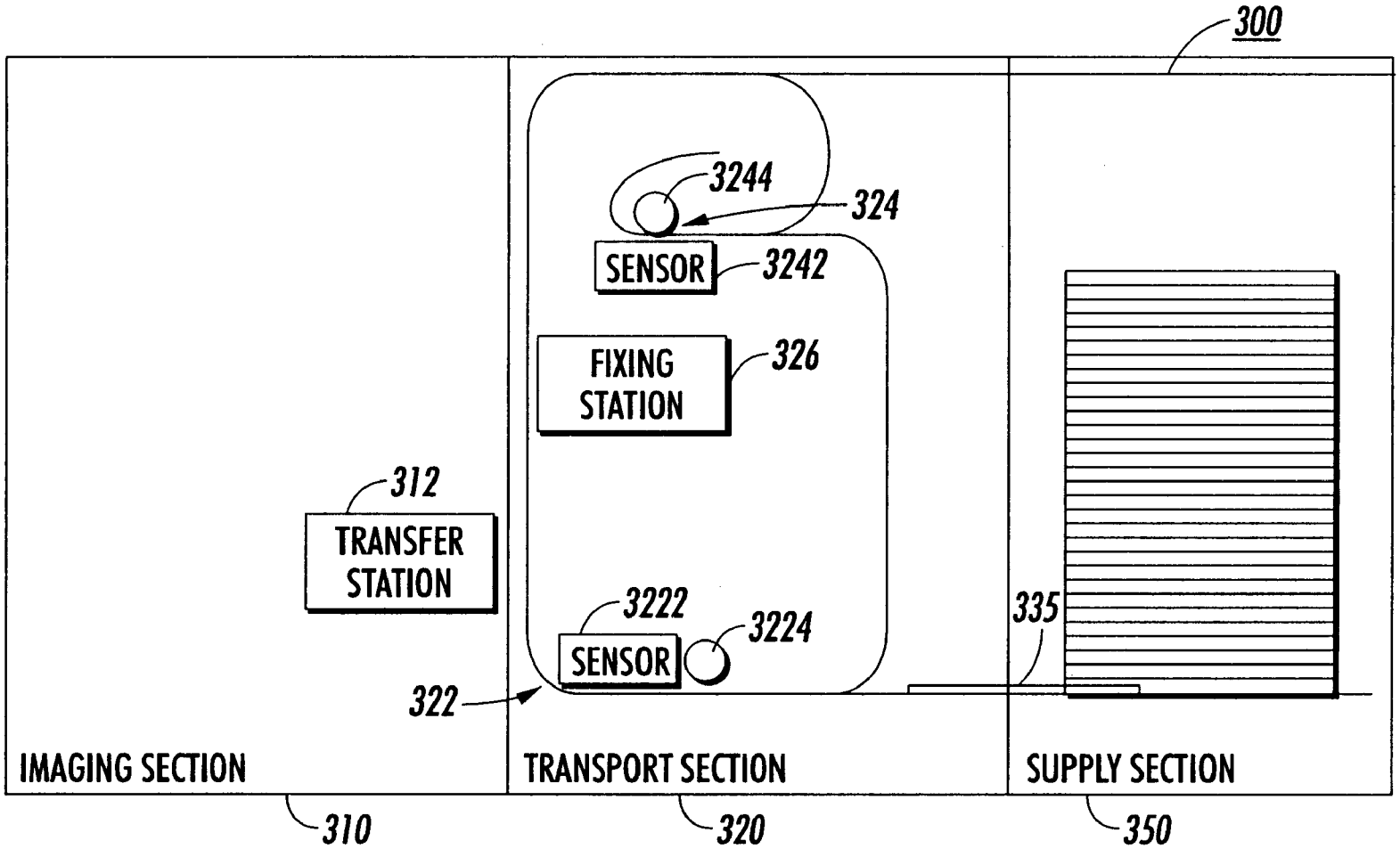
FIG. 2 shows one exemplary embodiment of an image output terminal shown in FIG. 1.

FIG. 2 shows one exemplary embodiment of the image output terminal 300 according to this invention. As shown in FIG. 2, the image output terminal 300 includes an imaging section 310, a transport section 320, and a supply section 330. Images imaged in the imaging section 310 are developed and transferred at a transfer station 312 to a receiving substrate 335 delivered by the supply section 330 and transported in the transport section 320. For transfer, the receiving substrate 335 is brought forward from the supply section 330 to the transfer station 312 in timed registration with the developed image in the imaging station 310.

The transport section 320 of the image output terminal 300 includes a registration sensor 3222 and an inverting sensor 3242 that are used to register the receiving substrate 335 with the transfer station 312. The registration sensor 3222 senses the arrival of the trailing edge or leading edge of the receiving substrate 335 at the registration station 322. The inverter sensor 3242 senses the arrival of the trailing edge or the leading edge of the receiving substrate 335 at the inverting station 324. The registration and inverting sensors 3222 and 3242 output signals indicative of the arrival of the trailing edge or leading edge of the receiving substrate 335 over the control and data bus 250 to the feed out control circuit 240.

The feed out control circuit 240 inputs the signals from the registration and inverting sensors 3222 and 3242 and determines whether or not to increase or decrease the stop time of an inverting roller 3244 of the inverting station 324 to feed the receiving substrate 335 out from the inverting station 324. That is, the feed out control unit 240 determines how long the inverting roller 3244 is stopped between the forward rotation of the inverting roller 3244 where the receiving substrate 335 is transported to the inverting station 324 and the reverse rotation of the inverting roller 3244 where the receiving substrate 335 is transported out of the inverting station 324.

The feed out control circuit 240 then determines the amount of adjustments to be made to the stop time of the inverting roller 3244. Based on the adjustment determined by the feed out controller 240, the feed out controller 240 modifies the stop time of the inverting roller 3244 to feed out the receiving substrate 335 from the inverting station 324. Accordingly, when the developed images are transferred to the receiving substrate 335 at the transfer station 312, the resulting image will be substantially registered onto the receiving substrate 335.

Figure 3:
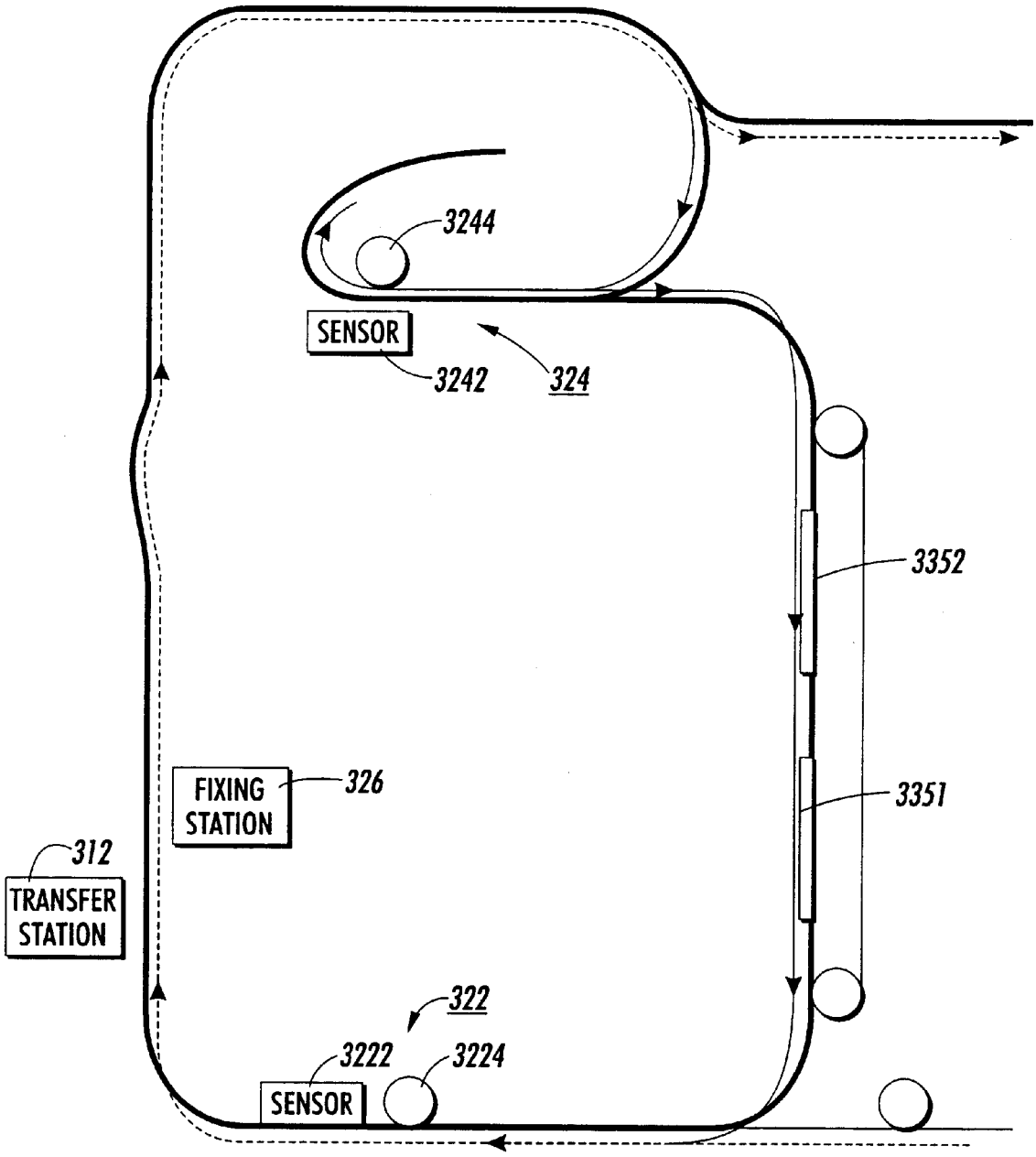
FIG. 3 shows one exemplary embodiment of a transport section shown in FIG. 2.

FIG. 3 illustrates in further detail, the transport section 320 in the system of FIG. 2 containing a pair of receiving substrates 3351 and 3352. In FIG. 3, the path in the transport section 320 through which the receiving substrate 3351 or 3352 travels during duplex imaging is illustrated by the arrowed solid lines. In contrast, the path through which the receiving substrate 3351 or 3352 travels during simplex imaging is illustrated by the arrowed broken lines. After the receiving substrate 3351 or 3352 is supplied from the supply section 330, the receiving substrate 3351 or 3352 is conveyed past the image transfer station 312 of the imaging section 310 to receive an image. The received image is permanently fixed or fused to the receiving substrate 3351 or 3352 after transfer at the fixing station 326 of the transport section 320. If the receiving substrate 3351 or 3352 is either a simplex receiving substrate or a duplex receiving substrate on which both of the side one and side two images have been formed, the receiving substrate 3351 or 3352 will be conveyed out of the transport section 320. If the receiving substrate 3351 or 3352 is a duplex receiving substrate printed only with a side one image, a gate (not shown) deflects the receiving substrate 3351 or 3352 into an inverting station 324 of the transport section 320. In the inverting section 324, the receiving substrate 3351 or 3352 will be inverted and recirculated past the transfer station 312 and the fixing station 326 for receiving and permanently fixing the side two image to the back side of the receiving substrate 3351 or 3352.

The registration and inverting sensors 3222 and 3242 monitor the leading edge and/or the trailing edge in the transport section 320 and are connected to the feed out control circuit 240. In addition, the feed out control circuit 240 regulates the stop time of the inverting roller 3244 in response to the detection of the leading and/or trailing edges of the receiving substrate 3351 or 3352 by the registration and inverting sensors 3222 and 3242.

In various exemplary embodiments of the systems and methods of this invention, the manner in which the receiving substrates 3351 and 3352 are scheduled for receiving developed images from the imaging system 310 is controlled based on when the two adjacent receiving substrates 3351 and 3352 are fed out of the inverting station 324.

The first receiving substrate 3351 is transported past the registration station 322 and a first image is transferred to side one of the first receiving substrate 3351 at the transfer station 312. Side one of the first receiving substrate 3351 is followed by side one of the second receiving substrate 3352. As the first receiving substrate 3351 is conveyed out of the transfer station 312, the second receiving substrate 3352 is conveyed through the transfer station 312 and a second image is transferred to side one of the second receiving substrate 3352. After transfer, the first receiving substrate 3351 and the second receiving substrate 3352 are transported past the fixing station 326 to fix the first and second transferred images on side one of the receiving substrates 3351 and 3352, respectively, at the fixing station 326. The first and second receiving substrates 3351 and 3352 are then transported to the inverting station 324 so that side two of the first and second receiving substrates 3351 and 3352 can be exposed to the registration station 322, the transfer station 312 and the fixing station 326. Because both sides of the first and second receiving substrates 3351 and 3352 have received images, the first and second receiving substrates 3351 and 3352 are not again sent to the inverting station 324 for recirculation. Rather, the completed first and second receiving substrates 3351 and 3352 are output from the transport section 320 for further processing.

In the registration station 322, the registration roller 3224 registers the receiving substrate 3352 with the transfer station 312. This is done by slowing down or speeding up the rotation of the registration roller 3224 so that feeding the receiving substrate 3352 out of the registration station 322 to the transfer station 312 is synchronized with the receipt of the developed images at the transfer station 312.

In the inverting station 324, the inverting roller 3244 controls feeding the receiving substrate 3352 from the inverting station 324. This is done by holding the stop time of the inverting roller 3244 so that feeding the receiving substrate 3352 out of the inverting station 324 to eventually arrive at the transfer station 312 is synchronized with the receipt of the developed images at the transfer station 312.

However, as the speed of the image output terminal 300 increases, speeding up and slowing down the registration roller 3224 or adjusting the stop time of the inverting roller 3244 may be insufficient to register the receiving substrates 3351 and 3352 with the developed images. That is, if the speed of the registration roller 3224 must be changed significantly in a short amount of time, for example, from a high speed to a significantly lower speed, there may be not enough time to adjust the speed of the registration roller 3224 to the required speed. If the registration roller 3224 cannot be slowed down enough to the appropriate speed, the trailing edge of the receiving substrate 3351 or 3352 will not leave the registration roller 3224 fast enough, and buckling occurs in the receiving substrate 3351 or 3352. If the speed of the registration roller 3224 cannot be increased to the appropriate speed, the leading edge of the receiving substrate 3351 or 3352 will hit the registration roller 3224 the registration roller 3224 before the registration roller 3224 is up to speed, and damage to the leading edge can occur.

In accordance with one exemplary embodiment of the systems and methods of this invention, the relationship between the trailing edge of a first receiving substrate 3351 and the leading edge of a second receiving substrate 3352 is monitored at the registration station 322 and the inverting station 324. In this exemplary embodiment, predetermined failure values are determined. The predetermined failure values are values where the relationship between the trailing edge of a first receiving substrate 3351 and the leading edge of a second receiving substrate 3352 is too small to accurately control of the speed of the registration roller 3224 and the stop time of the inverting roller 3244. That is, if the relationship between the trailing edge and the leading edge is not within the predetermined failure values, there is insufficient time to change the speed of the registration roller 3224 or stop time of the inverting roller 3244 to control the registration of the receiving substrates 3351 and 3352.

In accordance with another exemplary embodiment of the systems and methods of this invention, the feed out control circuit 240 controls the speed and stop time of the inverting roller 3244 in accordance with the monitored relationship between the trailing edge of a first receiving substrate 3351 and the leading edge of a second receiving substrate 3352 at the registration station 322 and the inverting station 324. That is, the inverting roller 3244 is stopped for a short time or a long time depending on the monitored relationship at the registration station 322 and the inverting station 324.

If the monitored relationship at the registration station 322 is greater than the predetermined failure values, then the first receiving substrate 3351 can be fed out of the inverting station 324 at an earlier time. This can be done by decreasing the stop time of the inverting roller 3244. If the monitored relationship at the registration station 322 is less than the first and second predetermined failure values, then the first receiving substrate 3351 must be fed out from the inverting station 324 at a later time. This can be done by increasing the stop time of the inverting roller 3244.

If the monitored relationship at the inverting station 324 is greater than the predetermined failure values, then the first receiving substrate 3351 can be fed out of the inverting station 324 at a later time. This can be done by increasing the stop time of the inverting roller 3244. If the monitored relationship at the inverting station 324 is less than the first and second predetermined failure values, then the first receiving substrate 3351 must be fed out from the inverting station 324 at an earlier time. This can be done by decreasing the stop time of the inverting roller 3244. Thus, the inverting roller 3244 is operated within a window of the first and second predetermined failure values by determining and centering the speed of the inverting roller 3244 within the window.

Figure 4:
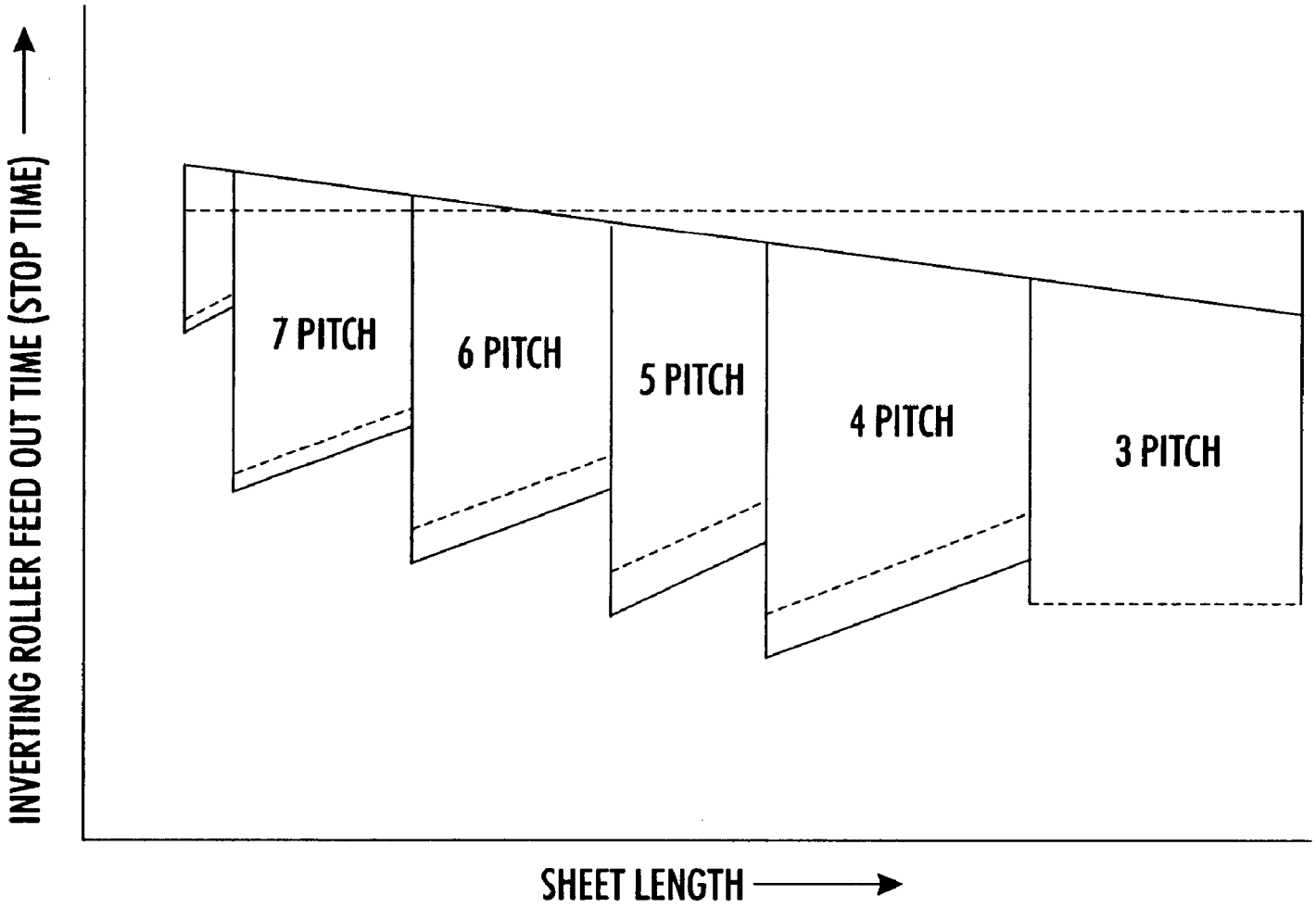
FIG. 4 shows one exemplary embodiment of an operating window for operating the inverting roller shown in FIG. 3.

FIG. 4 shows one exemplary embodiment of an operating window for operating the registration roller 3224 and the inverting roller 3244. As shown in FIG. 4, for a given trailing edge/leading edge relationship between two consecutive receiving substrates 3351 and 3352, such as the pitch between the receiving substrates 3351 and 3352, there is an operating window for operating the registration roller 3224 and the inverting roller 3244. A "pitch" is the portion of the transport path in the process direction which is determined by the leading edge of the first substrate 3351 and the leading edge of the second substrate 3352 as they move through the transport path.

The upper solid line of the window represents the maximum feed out time of maximum stop time of the inverting roller 3244 for that pitch within the predetermined failure values, while the lower dash line represents the minimum feed out time or minimum stop time of the inverting roller 3244 for that pitch within the predetermined values. That is, failure occurs if the feed out time of the inverting roller 3244 is above the upper solid line or below the lower dash line in FIG. 4 for a given pitch.

For example, if the feed out time required for operating the inverting roller 3244 is too high, then the speed of the inverting roller 3244 cannot be adjusted quick enough to match the required speed, and the trailing edge of the receiving substrate 335 comes out of the inverting station 324 too late. In such case, the leading edge of the receiving substrate 3351 or 3352 may hit the inverting roller 3244 before the inverting roller is up to speed, which can result in failure. On the other hand, if the stop time required for operating the inverting roller 3244 is too low and the speed of the inverting roller 3244 cannot be slowed down quick enough to match the required speed, the receiving substrate 3351 or 3352 comes out of the registration station 322 too early, before arrival of the developed image, which may also result in failure.

In one exemplary embodiment of the application of the operating window, the registration sensor 3222 detects the arrival of the trail edge and lead edge of the first receiving substrate 3351 and the second receiving substrate 3352 at the transfer station 312, and the detected data is input to the feed out control circuit 240. The feed out control circuit 240 then determines the trail edge to lead edge relationship and controls the stop time of the inverting roller 3244 to be within the window for a given pitch, as shown in FIG. 4, based on the detected data. That is, the stop time of the inverting roller 3244 can only be raised up to the upper solid line without failure, i.e., the receiving substrates hit the inverting roller 3244 before the inverting roller 3244 is up to speed due to insufficient time in between feeding, or lowered down to the lower dash line without failure. In another exemplary embodiment of the application of the operating window, the speed of the roller is determined as the center speed between the upper solid line and the lower dash line of the window.

Accordingly, in accordance with the systems and methods of this invention, the feed out control circuit 240 controls the stop time of the inverting roller 3244 based the relationship of the trailing edge and the leading edge of consecutive receiving substrates detected by the registration and inverting sensors 3222 and 3242.

Figure 5:
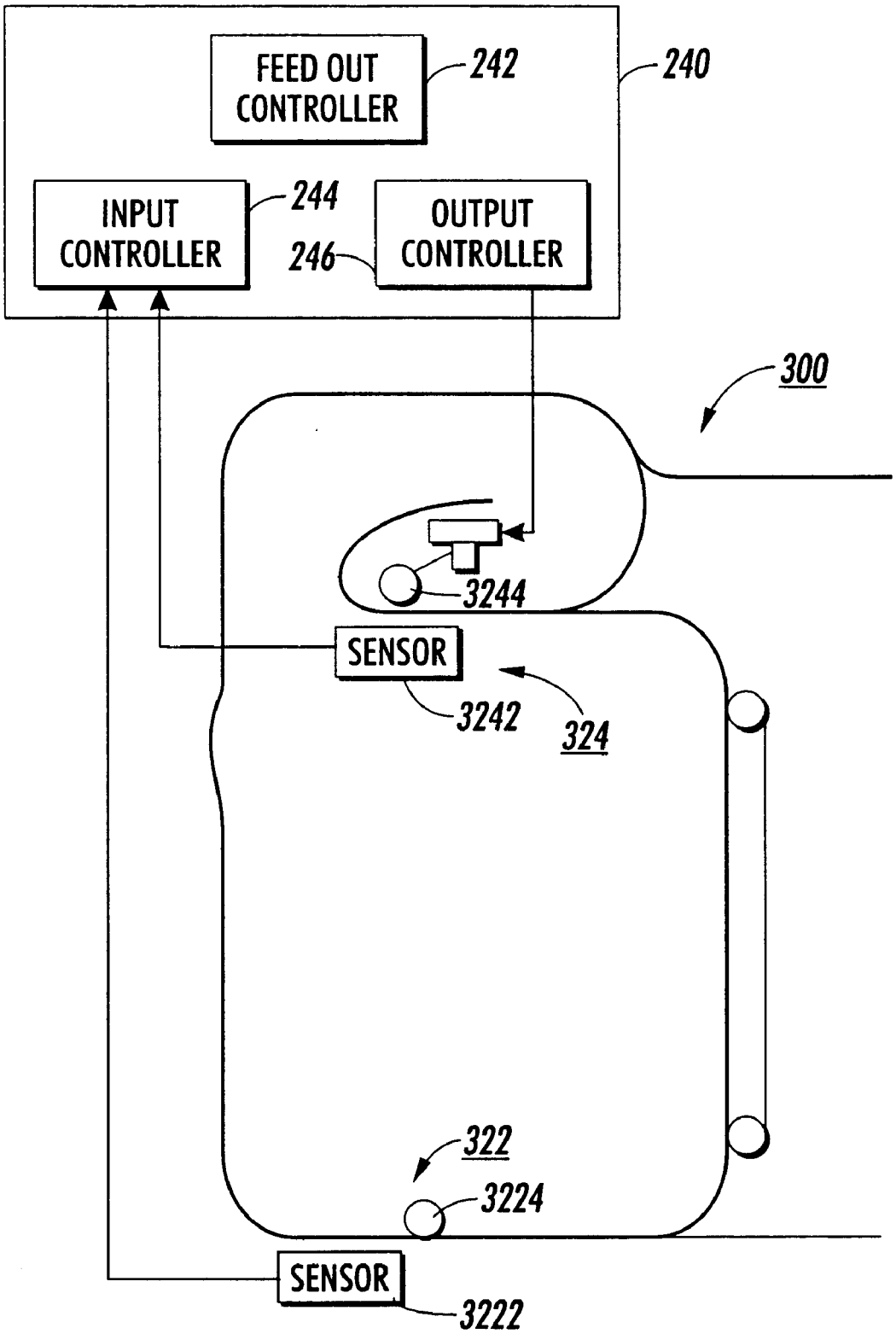
FIG. 5 shows one exemplary embodiment of the image output terminal and the feed out control circuit of this invention.

FIG. 5 shows one exemplary embodiment of the image output terminal 300 and the feed out control circuit 240. As shown in FIG. 5, in this exemplary embodiment of the image output terminal 300, each of the registration and inverting sensors 3222 and 3242 provides feed out signals to the feed out control circuit 240. The feed out control circuit 240 adjusts the stop time of the inverting roller 3244 based on the input feed out signals to control when to feed the receiving substrate 3351 or 3352 out of the inverting station 324.

As shown in FIG. 5, the feed out control unit 240 controls the feed out of the receiving substrate 3351 or 3352 to be fed out at an earlier time or a later time. In particular, by controlling the stop time of the inverting roller 3244, the feed out of the receiving substrate 3351 or 3352 from the inverting station 324 can be very precisely controlled.

As shown in FIG. 5, the feed out control circuit 240 includes a feed out controller 242, an input controller 244, and an output controller 246. In FIG. 5, the output controller 246 controls the output to a motor (not shown) which controls the speed and stop time of the inverting roller 3244. The input controller 244 receives the signals input from the registration and inverting sensors 3222 and 3242.

In FIG. 5, the feed out controller 242 is connected to the input controller 244 which receives the detection results from the registration and inverting sensors 3222 and 3242. As the receiving substrates 3351 and 3352 are transported through the transport section 320, the relationship between the trailing edge and the leading edge of the receiving substrates 3351 and 3352 at the registration station 322 is sensed by the sensor 3222 and the relationship between the trailing edge and the leading edge of the receiving substrates 3351 and 3352 at the inverting station 324 is sensed by the inverting sensor 3242. The sensed results are then input to the input controller 244.

The feed out controller 242 determines the required adjustments to the feed out time at the inverting station 324, and then modifies the feed out control signals for the inverting roller 3244. The output controller 246 then controllably outputs the feed out control signals to the motor of the inverting roller 3244 based on the adjustments.

During set-up, the feed out controller 242 collects data on the stop time of the inverting roller 3244. The feed out controller 242 reduces this data to an average profile in a form of a nominal or reference table with one print for each sample time. The feed out controller 240 then uses this reference table when determining adjustments to the stop time of the inverting roller 3244 during a print run. This reference table serves as a link between the set-up measurements and the feed out controller measurements which will infer registration.

During the imaging process, the nominal reference table is used and the feed out adjustment is determined as the difference between the nominal and the current measurement. The feed out controller 242 repeats this determination throughout the print run to keep the images and the receiving substrate registered.

Figure 6:
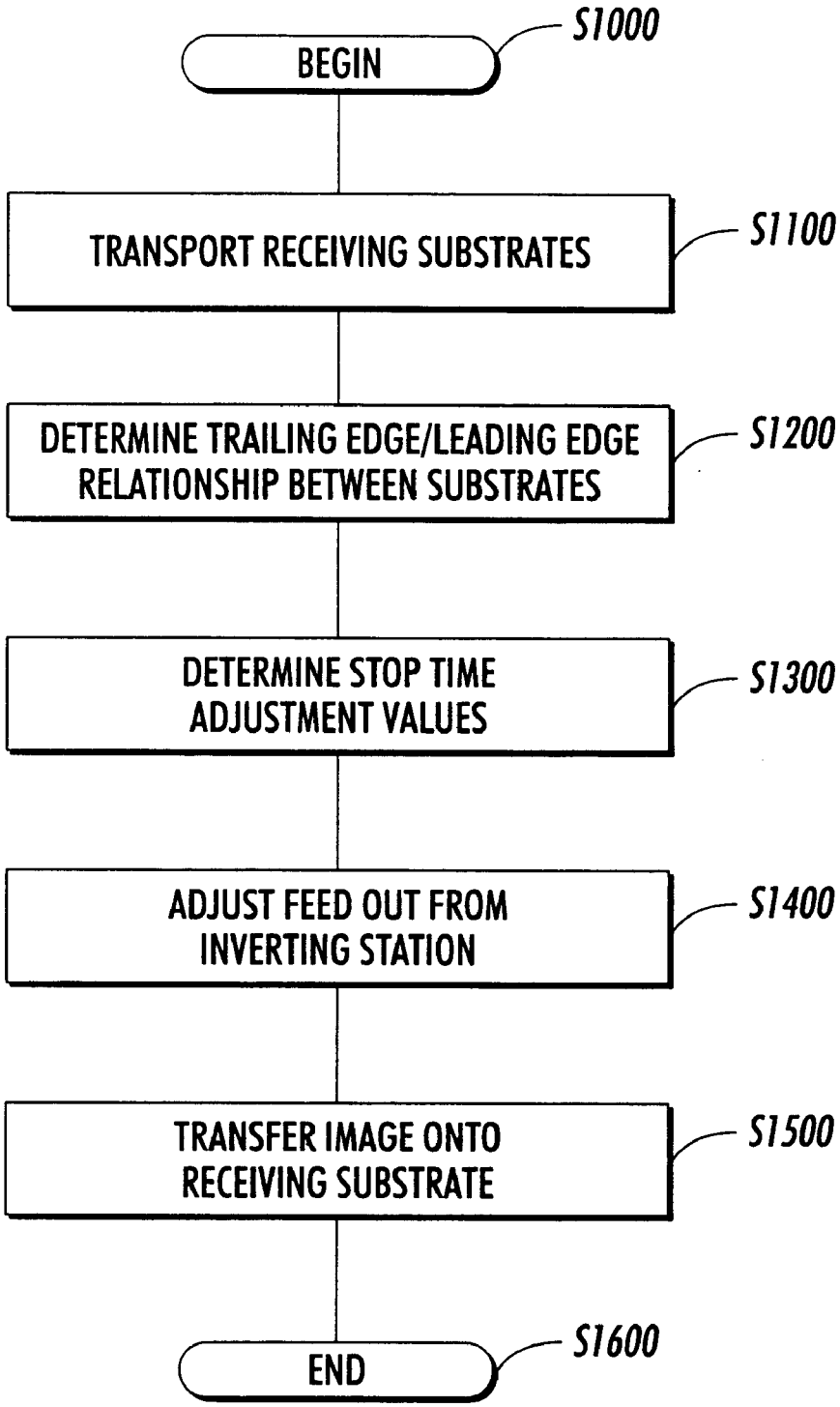
FIG. 6 illustrates in greater detail one exemplary embodiment of controlling feeding out a receiving substrate from the inverting station according to this invention.

FIG. 6 is a flowchart outlining one exemplary embodiment of a method for controlling feeding out a receiving substrate according to this invention.

Beginning in step S1000, control continues to step S1100, where the first and second receiving substrates are transported. Next, in step S1200, the trailing edge/leading edge relationship between the first and second receiving substrates is determined. Then, in step S1300, stop time adjustment values for the inverting roller are determined based on the determined trailing edge/leading edge relationship. Control then continues to step S1400.

In step S1400, based on the stop time adjustment values determined, feeding out the receiving substrate from the inverting station is adjusted to keep a developed image registered with the receiving substrate so that any displayed or printed image will appear without misregistration. Next, in step S1500, the image is transferred onto the final receiving substrate. Then, in step S1600, the control routine ends.

It is to be appreciated that this invention need not only be used to control the stop time of the inverting roller. For example, the invention could be used to determine the stop time or speed of various rollers. Thus, it should be appreciated that various other modifications and changes may occur to those skilled in the art.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A substrate transport device, comprising:

a transport path;

at least two sensors provided adjacent to the transport path that sense a trailing edge of a first substrate on the transport path and a leading edge of a second substrate on the transport path;

an edge relationship circuit that determines a relationship between the trailing edge of the first substrate and the leading edge of the second substrate sensed by the at least two sensors; and a feed out circuit that determines a feed out condition for feeding out the second substrate from a predetermined position along the transport path based on the determined relationship, wherein the predetermined position is the inverting station.

2. The substrate transport device of claim 1, wherein the transport path is a duplex path.

3. The substrate transport device of claim 2, wherein one of the at least two sensors is provided adjacent a registration station of the duplex path.

4. The substrate transport device of claim 3, wherein one of the at least two sensors is provided adjacent an inverting station of the duplex path.

5. The substrate transport device of claim 1, wherein the feed out circuit determines a stop time of an inverting roller at the inverting station.

6. The substrate transport device of claim 5, further comprises a speed adjustment circuit that adjusts the stop time of the inverting roller based on the determined stop time.

7. The substrate transport device of claim 1, wherein the feed out circuit determines a feed out speed of an inverting roller at the inverting station.

8. The substrate transport device of claim 7, further comprises a speed adjustment circuit that adjusts the feed out speed of the inverting roller based on the determined feed out speed.

9. The substrate transport device of claim 4, further comprises an operating window circuit that determines an operating window for feeding out from the registration station and an operating window for feeding out from the inverting station.

10. The substrate transport device of claim 9, wherein the feed out circuit centers the operating windows of the registration station and the inverting station.

11. The substrate transport device of claim 10, wherein the feed out circuit determines the feed out condition based on the centered operating windows.

12. A method for feeding out receiving substrates, comprising:

transporting a first receiving substrate and a second receiving substrate along a transport path;

sensing a trailing edge of the first substrate and a leading edge of the second substrate at at least two locations on the transport path;

determining a relationship between the trailing edge of the first substrate and the leading edge of the second substrate sensed at the at least two locations; and determining a feed out condition for feeding out the second substrate from a predetermined position along the transport path based on the determined relationship, wherein the predetermined position is the inverting station.

13. The method of claim 12, wherein the transport path is a duplex path.

14. The method of claim 13, wherein one of the at least two locations is a registration station of the duplex path.

15. The method of claim 14, wherein one of the at least two locations is an inverting station of the duplex path.

16. The method of claim 12, further comprises determining a stop time of an inverting roller at the inverting station.

17. The method of claim 16, farther adjusting the stop time of the inverting roller based on the determined stop time.

18. The method of claim 12, further comprises determining a feed out speed of an inverting roller at the inverting station.

19. The method of claim 18, further adjusting the feed out speed of the inverting roller based on the determined feed out speed.

20. The method of claim 15, further comprises determining an operating window for feeding out from the registration station and an operating window for feeding out from the inverting station.

21. The method of claim 20, further comprises centering the operating windows of the registration station and the inverting station.

22. The method of claim 21, further comprises determining the feed out condition based on the centered operating windows.

* * * * *